US012422234B2

(12) United States Patent
Koehler

(10) Patent No.: US 12,422,234 B2
(45) Date of Patent: Sep. 23, 2025

(54) INTEGRATED DRIVING BAND OBTURATOR FOR ARTILLERY

(71) Applicant: Raytheon Company, Arlington, VA (US)

(72) Inventor: Frederick B. Koehler, Tucson, AZ (US)

(73) Assignee: Raytheon Company, Arlington, VA (US)

( * ) Notice: Subject to any disclaimer, the term of this patent is extended or adjusted under 35 U.S.C. 154(b) by 0 days.

(21) Appl. No.: 18/592,293

(22) Filed: Feb. 29, 2024

(65) Prior Publication Data

US 2025/0277655 A1 Sep. 4, 2025

(51) Int. Cl.
*F42B 14/02* (2006.01)

(52) U.S. Cl.
CPC ..... *F42B 14/02* (2013.01)

(58) Field of Classification Search
CPC ..... F42B 14/02
USPC ..... 102/524
See application file for complete search history.

(56) References Cited

U.S. PATENT DOCUMENTS

| | | | | |
|---|---|---|---|---|
| 4,532,868 | A | 8/1985 | Gleichaut et al. | |
| 6,295,934 | B1 * | 10/2001 | Tepera | F42B 14/02 102/527 |
| 6,369,373 | B1 * | 4/2002 | Tepera | F42B 14/00 89/47 |
| 6,453,821 | B1 * | 9/2002 | Fowler | F42B 14/02 102/527 |
| 7,226,016 | B2 | 6/2007 | Johnsson et al. | |
| 7,748,325 | B2 | 7/2010 | Marx | |
| 9,689,649 | B1 * | 6/2017 | Hooke | F42B 14/02 |
| 11,035,655 | B2 | 6/2021 | Paesch et al. | |
| 2003/0145757 | A1 | 8/2003 | Fischer et al. | |
| 2020/0080823 | A1 * | 3/2020 | Paesch | F42B 14/02 |

FOREIGN PATENT DOCUMENTS

| | | |
|---|---|---|
| FR | 396083 | 4/1909 |
| RU | 2169342 | 6/2001 |
| RU | 2611272 | 2/2017 |

OTHER PUBLICATIONS

"International Application Serial No. PCT US2025 016612, International Search Report mailed Jun. 10, 2025", 4 pgs.
"International Application Serial No. PCT US2025 016612, Written Opinion mailed Jun. 10, 2025", 13 pgs.

* cited by examiner

*Primary Examiner* — Samir Abdosh
(74) *Attorney, Agent, or Firm* — Schwegman Lundberg & Woessner, P.A.

(57) ABSTRACT

A projectile that includes an artillery shell having a casing that defines a surface is provided. The projectile has an obturator that includes an obturator first material layer on the casing surface and an obturator second material layer on the obturator first material layer. The obturator also has an obturator third material layer on the obturator second material layer. The projectile also has a driving band that includes a driving band first material layer on the casing surface and a driving band second material layer on the driving band first material layer. Additionally, the projectile includes a driving band lead-in having a driving band lead-in first material layer on the casing surface and a driving band lead-in second material layer on the driving band lead-in first material layer.

20 Claims, 9 Drawing Sheets

INTEGRATED DRIVING BAND OBTURATOR FOR ARTILLERY

TECHNICAL FIELD

Examples relate to projectiles and more specifically to an obturator for projectiles and a method of forming an obturator onto projectiles.

BACKGROUND

A projectile can be fired from a weapon with a propellant. Typically, the propellant can be formed from various chemical substances that can rapidly generate gas that causes a pressure differential between a aft position of a barrel of the weapon ad a fore position of the barrel. The pressure differential can cause the acceleration of projectile through the barrel and from the weapon. Many propellants use exothermic reactions to generate gases that can increase pressure.

When projectile is within the barrel of a weapon, in order to prevent pressure loss by the generated gases escaping around the projectile instead of being restricted to behind the projectile and thereby pushing the projectile forward and through the barrel, the projectile can include an obturator. The obturator can function as a gasket that can help minimize the possibility of gas escaping around the projectile. In addition, during firing, rifling within the barrel causes rotation of the projectile. In order to stabilize the projectile during rotation and in flight, the projectile can include a rotating band that engages the rifling.

Typically, the obturator and the rotating band are separate, individual components. These components are attached to the projectile prior to placing the projectile within the weapon, and typically during the manufacturing process. By virtue of being added to the body of the projectile, the components, they can separate from the projectile during firing. If the rotating band separates it can cause damage to the barrel and destabilize the projectile during firing. If the obturator separates, pressure is lost and therefore range and stability can be diminished.

DETAILED DESCRIPTION

The following description and the drawings sufficiently illustrate teachings to enable those skilled in the art to practice them. Other embodiments may incorporate structural, logical, electrical, process, and other changes. Portions and features of some examples may be included in, or substituted for, those of other examples. Teachings set forth in the claims encompass all available equivalents of those claims.

Examples relate to an obturator, a driving band and a driving band lead-in for a projectile and a method of forming the obturator, the driving band, and driving band lead-in on a casing surface of the projectile. The obturator can function as a seal that can minimize the escaping of gases from an aft end of projectile to a forward end of the projectile during firing of the projectile from a weapon. The obturator can be formed at the aft end and can include a plurality of materials. The obturator can include a first material disposed at the casing surface. The first material can be formed of a material that can form a strong bond with the casing surface. The first material can transition to a second material that can be softer than the first material. The second material can transition to a third material that can be softer than the second material and can have a lower melting point than the second material. The softer nature of the third material can allow the third material to form a seal against a barrel of the weapon during firing. Each of the first material, the second material, and third material can form an obturator material profile. As used herein, a material profile can relate to a distribution of different materials and how materials within the profile transition from one material to the next.

The driving band can also include the first material disposed at the casing surface. The first material can transition to the second material. Here, the first material and the second material of the driving band can form a driving band material profile. The driving band material profile can be different from the obturator material profile.

The driving band lead-in can also include the first material disposed at the casing surface that transitions to the second material. In some examples, the driving band lead-in can include the third material where the second material transitions to the third material. The first material and the second material of the driving band lead-in can form a driving band lead-in material profile that can be different from the obturator material profile and the driving band material profile. When the driving band lead-in includes the third material, the driving band lead-in material profile can be different from the obturator material profile and the driving band material profile. An advantage of examples relates to improved adhesion to a casing. Bands can get ripped off. However, examples address this problem by starting with a high adhesive layer and then a blended transition from metal to plastic.

Figure 1:
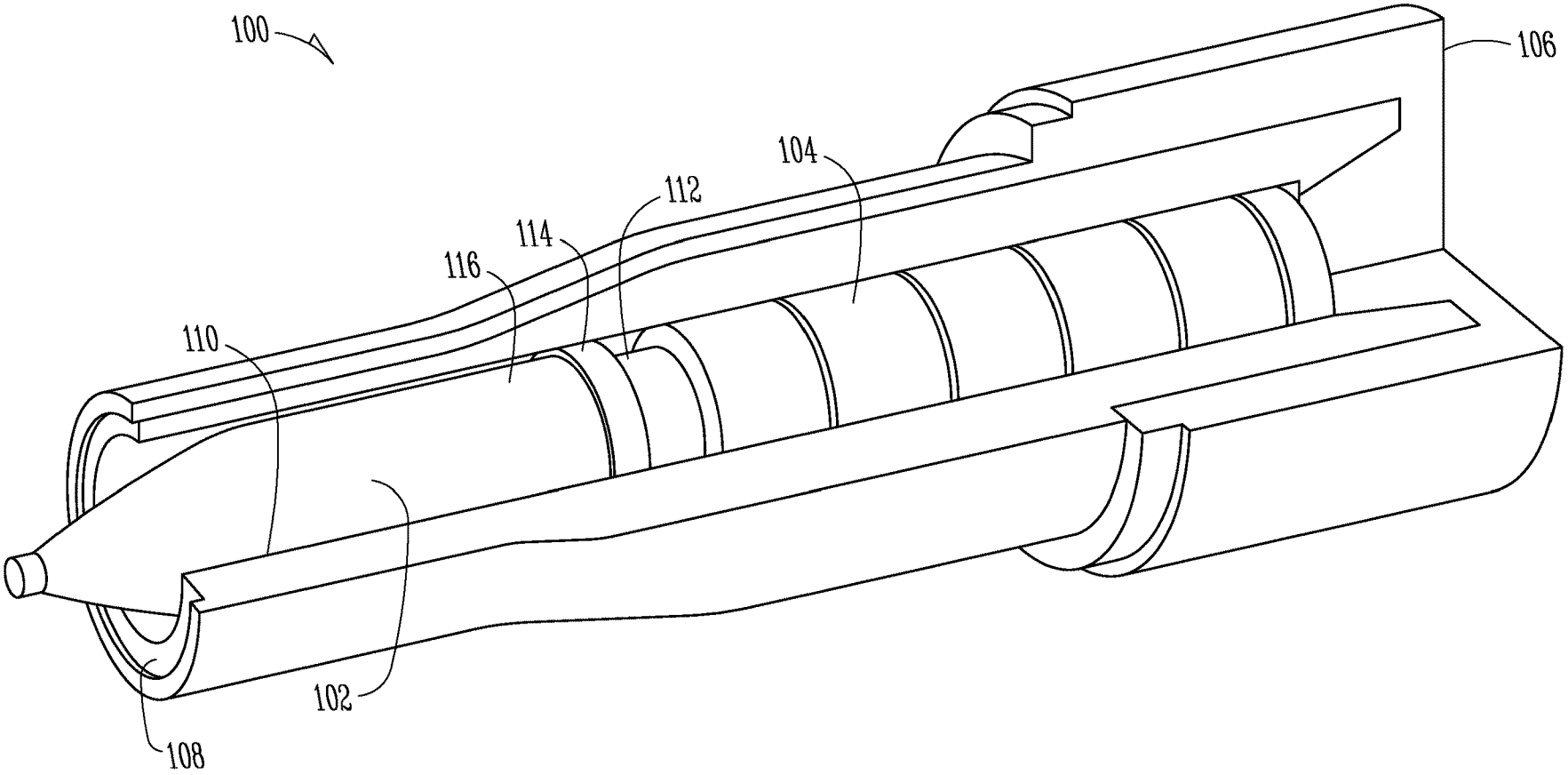
FIG. 1 illustrates, by way of example, a weapon having projectile and propellant, in accordance with examples.

Now making reference to FIG. 1, a weapon 100 is shown having a projectile 102 and propellant 104. The propellant 104 can include a chemical substance that causes a pressure differential between an aft end 106 of the weapon 100 and a forward end 108 of the weapon 100. The pressure differential can cause the acceleration of the projectile 102 through a barrel 110 and from the weapon 100.

The projectile 102 can include an obturator 112 where the obturator 112 can abut a driving band 114. The driving band 114 can be forward of the obturator 112 where the driving band 114 can be closer to the forward end 108 in comparison to the obturator 112 while the obturator 112 can be closer to the aft end 106 in comparison to the driving band 114. Each of the obturator 112 and the driving band 114 can be directly disposed on a casing surface 116 of the projectile 102. The obturator 112 can be disposed aft of the driving band 114 and adjacent the propellant 104. The driving band 114 can function to assist with the rotation of the projectile 102 during discharge of the projectile 102 from the weapon 100. When the propellent 106 is activated to create a pressure differential between the weapon aft end 106 and the weapon forward end 108, the obturator 112 can function to minimize gases escaping around the projectile 102 and into the barrel 110 during discharge of the projectile 102 from the weapon 100.

Figure 2:
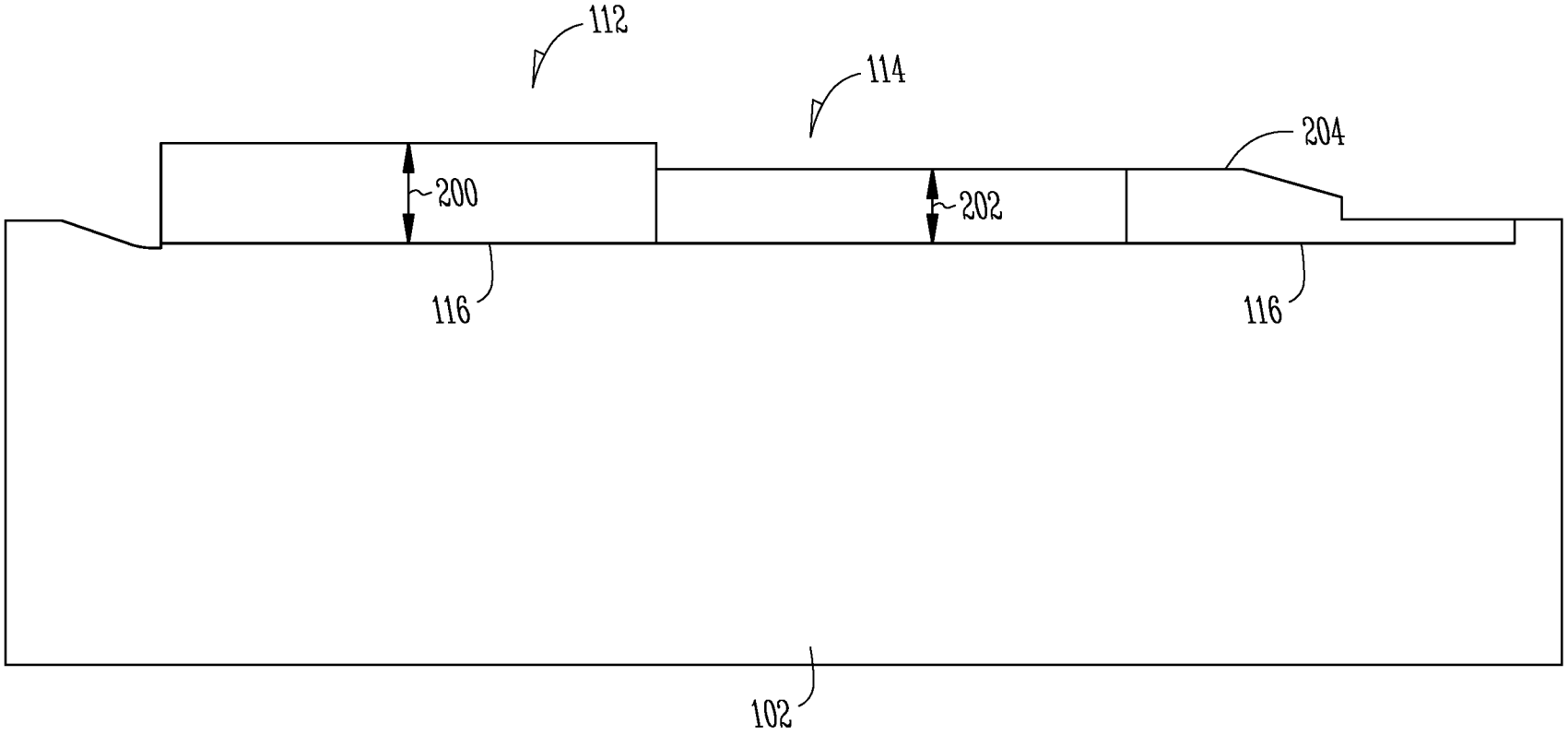
FIG. 2 shows an obturator, a driving band, and a driving band lead-in formed on the projectile of FIG. 1, in accordance with examples.

Making reference to FIG. 2, the obturator 112 can extend a distance 200 from the projectile casing surface 116. Furthermore, the driving band 114 can extend a distance 202 from the projectile casing surface 116 that is less than the distance 200. A driving band lead-in 204 can also be disposed on the projectile casing surface 116. The driving band lead-in 204 can abut the driving band 114 and be forward of the driving band 114 where the driving band lead-in 204 can be closer to the forward end 108 in comparison to the driving band 114 and the obturator 112. The driving band lead-in 204 can function to minimize gases from escaping around the projectile 102 and to the forward end 108 when the propellant 106 is activated.

Figure 3:
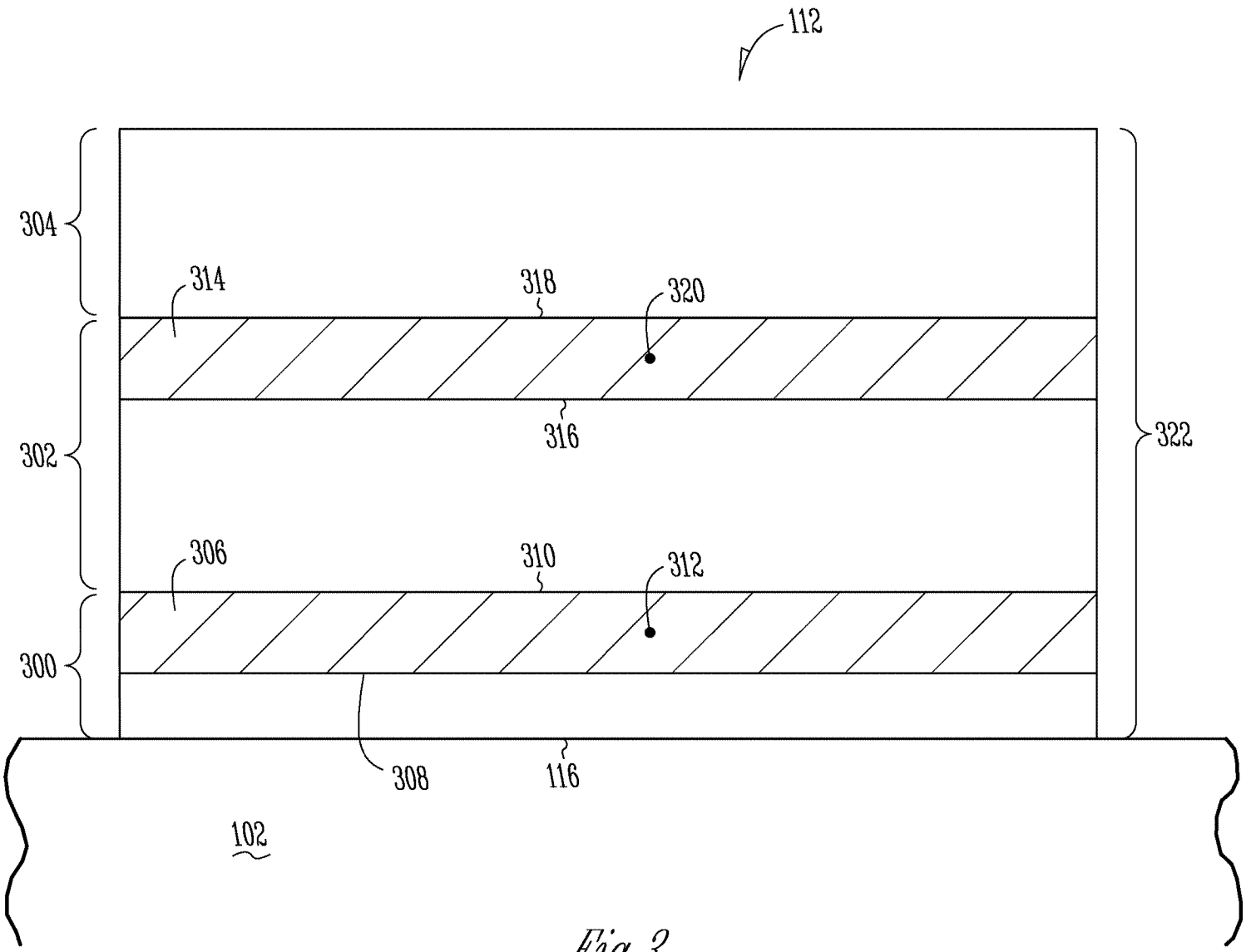
FIGS. 3 and 4 illustrate the formation of the obturator of FIG. 2, in accordance with examples.

Each of the obturator 112, the driving band 114, and the driving band lead-in 204 can be formed from different materials. As shown with reference to FIG. 3, the obturator 112 can include a first material layer 300 disposed directly on the projectile casing surface 116. The obturator first material layer 300 can be formed from a first material having a hardness that allows for robust bonding with the projectile casing surface 116. The first material of the obturator first material layer 300 can be such that the obturator first material layer 300 does not separate from the projectile casing surface 116 during discharge from the weapon 100. The hardness can be in a range of a Mohs hardness of 4.0 to a Mohs hardness of 6.0. An example of the first material can be nickel. Further examples can include tungsten and tantalum, Chromium, Molybdenum, and columbium.

The obturator 112 can also include a second material layer 302 disposed directly on the obturator first material layer 300. The obturator second material layer 302 can be formed from a second material having a hardness that is less than the first material of the obturator first material layer 300 and can deform when the projectile 102 is discharged from the weapon 100. The obturator second material layer 302 can deform in order to minimize damage to the barrel 110 when the projectile 102 is discharged from the weapon 100. The hardness can be in a range of a Mohs hardness of 1.0 to a Mohs hardness of 3.5. An example of the second material can be copper. Further examples can include polyether ether ketone (PEEK), acrylic, or the like. PEEK has a Shore D hardness of about 85 and Rockwell M of around 100. Acrylic a shore D of about 94 Rockwell M of about 70. In further examples, the copper can be an intermediate layer only.

Figure 4:
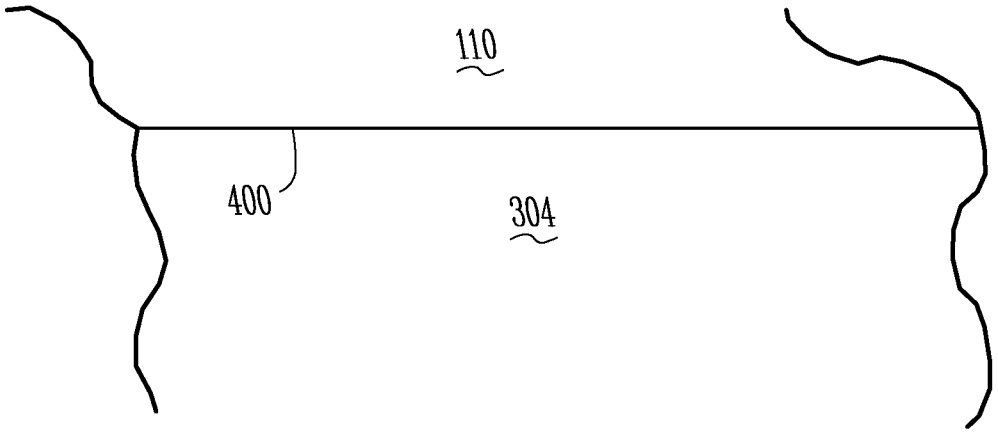

Additionally, the obturator 112 can have a third material layer 304 disposed directly on the obturator second material layer 302. The obturator third material layer 304 can be formed from a third material having a hardness that is less than the first material for the obturator first material layer 300 and the second material for the second obturator material layer 302. The third obturator material layer 304 can be formed from a material that can deform and form a seal 400 (FIG. 4) between the obturator third material layer 304 and the barrel 110 when the projectile 102 is discharged from the weapon 100. When the seal 400 is formed, the obturator third material layer can form a gasket that minimizes gases escaping around the projectile 102 and into the barrel 110 during discharge of the projectile 102 from the weapon 100. An example of the material can be High Density Polyethylene (HDPE). Further examples can include PEEK and acrylic.

The obturator first material layer 300 can include a transition layer 306 defined between the obturator first material layer 300 and the obturator second material layer 302. The obturator transition layer 306 can include both the first material and the second material where the obturator transition layer 306 can include a higher concentration of the first material near an area 308 and a higher concentration of the second material near an area 310. To further illustrate, at the area 308, the obturator transition layer 306 can have 100% of the first material and at the area 310 the obturator transition layer 306 can have 100% of the second material. The material concentration can vary linearly across the obturator transition layer 306 such that at a midpoint 312 the obturator transition layer 306 can have 50% of the first material and 50% of the second material. However, the material concentration can vary in any manner across the obturator transition layer 306 such that at the midpoint 312, the obturator transition layer 306 can have 80% of the first material and 20% of the second material, 60% of the first material and 40% of the second material, 40% of the first material and 60% of the second material, or vary in an exponential manner across the transition layer 306, or the like.

The obturator second material layer 302 can include a transition layer 314 defined between the obturator second material layer 302 and the obturator third material layer 304. The obturator transition layer 314 can include both the second material and the third material where the obturator transition layer 314 can include a higher concentration of the second material near an area 316 and a higher concentration of the third material near an area 318. To further illustrate, at the area 316, the obturator transition layer 314 can have 100% of the second material and at the area 318 the obturator transition layer 314 can have 100% of the third material. The material concentration can vary linearly across the obturator transition layer 314 such that at a midpoint 320, the obturator transition layer 314 can have 50% of the second material and 50% of the third material. However, the material concentration can vary in any manner across the obturator transition layer 314 such that at the midpoint 330, the obturator transition layer 314 can have 80% of the second material and 20% of the third material, 60% of the second material and 40% of the third material, 40% of the second material and 60% of the third material, or vary in an exponential manner across the transition layer 314, or the like.

The obturator 112 can have an obturator material profile 322. The obturator material profile 322 can be defined by the obturator first material layer 300, the obturator second material layer 302, and the obturator third material layer 304. In addition to being defined by the material layers 300-304, the obturator material profile 322 can be defined by the obturator transition layers 306 and 314 where the obturator transition layers 306 and 314 can define the obturator material profile 322 in conjunction with the material layers 300-304.

Figure 5:
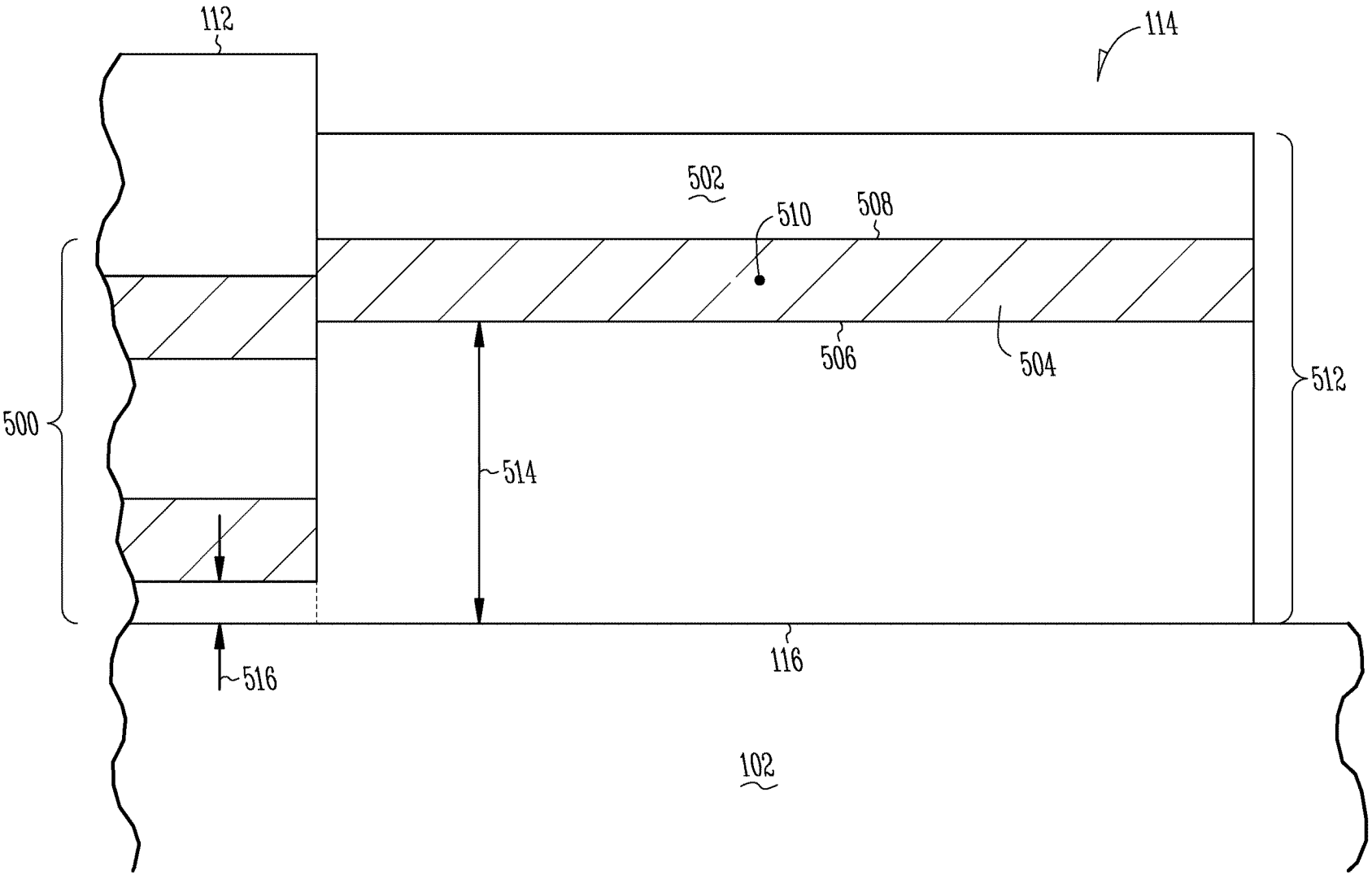
FIG. 5 illustrates the formation of the driving band of FIG. 2, in accordance with examples.

As noted above, the driving band 114 can be formed from different materials, as shown with reference to FIG. 5. The driving band 114 can include a first material layer 500 disposed directly on the projectile casing surface 116. The driving band first material layer 500 can be formed from the first material as discussed above with reference to the obturator first material layer 300. The driving band 114 can also include a second material layer 502 disposed directly on the driving band first material layer 500. The driving band second material layer 502 can be formed from the second material as discussed above with reference to the obturator second material layer 302.

The driving band first material layer 500 can include a transition layer 504 defined between the driving band first material layer 500 and the driving band second material layer 502. The driving band transition layer 504 can include both the first material and the second material where the driving band transition layer 504 can include a higher concentration of the first material near an area 506 and a higher concentration of the second material near an area 508. To further illustrate, at the area 506, the driving band transition layer 504 can have 100% of the first material and at the area 508 the driving band transition layer 504 can have 100% of the second material. The material concentration can vary linearly across the driving band transition layer 504 such that at a midpoint 510 the driving band transition layer 504 can have 50% of the first material and 50% of the second material. The material concentration can vary in any manner across the driving band transition layer 504 such that at the midpoint 510, the driving band transition layer 504 can have 80% of the first material and 20% of the second material, 60% of the first material and 40% of the second material, 40% of the first material and 60% of the second material, or vary in an exponential manner across the db transition layer 504, or the like.

The driving band 114 can have a driving band material profile 512. The driving band material profile 512 can be defined by the driving band first material layer 500 and the driving band second material layer 502. In addition to being defined by the material layers 500 and 502, the driving band material profile 512 can be defined by the driving band transition layer 504 where the driving band transition layer 504 can define the driving band material profile 512 in conjunction with the material layers 500 and 502.

The driving band driving band material profile 512 can differ from the obturator material profile 322. In particular, the driving band 114 can include more of the first material than the obturator 112 and less of the second material than the obturator 112. Thus, a width 514 corresponding to an amount of the first material in the driving band first material layer 500 can be greater than a width 516 corresponding to an amount of the first material in the obturator first material layer 300. As noted above, the driving band 114 can function to assist with the rotation of the projectile 102 during discharge of the projectile 102 from the weapon 100. Moreover, as noted above, the driving band first material layer 500 can be formed with a material having a high a hardness that allows for robust bonding with the projectile casing surface 116. During discharge, the driving band 114 can be subjected to high angular accelerations. In the past, high angular acceleration would contribute to the rotating band separating from the projectile during discharge. By virtue of employing the first material having the properties discussed above in the driving band first material layer 500, separation can be minimized due to the robust bonding.

Figure 6:
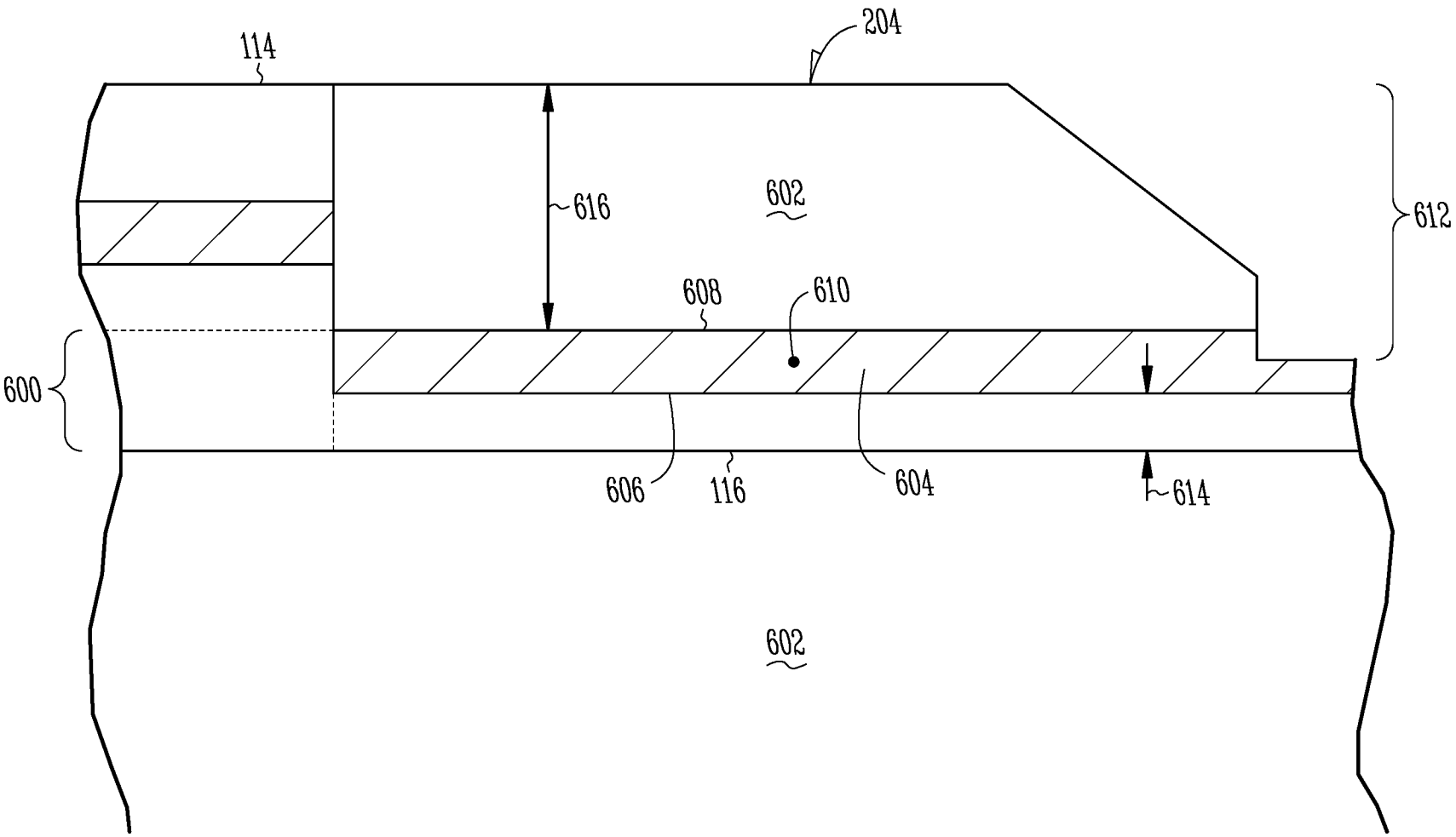
FIGS. 6 and 7 show the formation of the driving band lead-in of FIG. 2, in accordance with examples.
Figure 7:
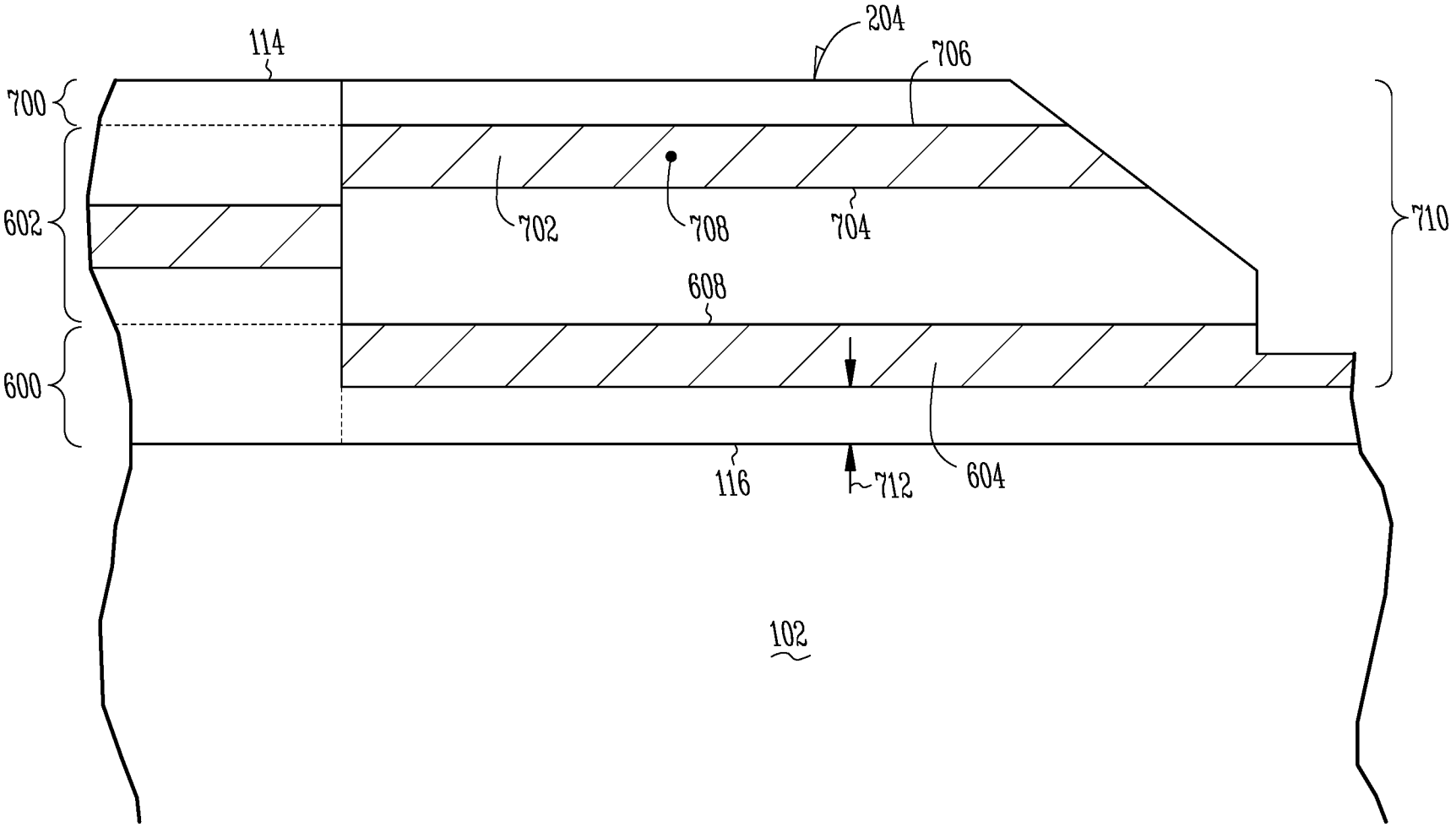

The driving band lead-in 204 can also be formed from different materials, as shown with reference to FIG. 6. The driving band lead-in 204 can include a first material layer 600 disposed directly on the projectile casing surface 116. The driving band lead-in first material layer 600 can be formed from the first material as discussed above with reference to the obturator first material layer 300. The driving band lead-in 204 can also include a second material layer 602 disposed directly on the driving band lead-in first material layer 600. The driving band lead-in second material layer 602 can be formed from the second material as discussed above with reference to the obturator second material layer 302.

The driving band lead-in first material layer 600 can include a transition layer 604 defined between the driving band lead-in first material layer 600 and the driving band lead-in second material layer 602. The driving band lead-in transition layer 604 can include both the first material and the second material where the driving band lead-in transition layer 604 can include a higher concentration of the first material near an area 606 and a higher concentration of the second material near an area 608. To further illustrate, at the area 606, the driving band lead-in transition layer 604 can have 100% of the first material and at the area 608 the driving band lead-in transition layer 604 can have 100% of the second material. The material concentration can vary linearly across the driving band lead-in transition layer 604 such that at a midpoint 610 the driving band lead-in transition layer 604 can have 50% of the first material and 50% of the second material. The material concentration can vary in any manner across the driving band lead-in transition layer 604 such that at the midpoint 610, the driving band lead-in transition layer 604 can have 80% of the first material and 20% of the second material, 60% of the first material and 40% of the second material, 40% of the first material and 60% of the second material, or vary in an exponential manner across the driving band lead-in transition layer 604, or the like.

The driving band lead-in 204 can have a driving band lead-in material profile 612. The driving band lead-in material profile 612 can be defined by the driving band lead-in first material layer 600 and the driving band lead-in second material layer 602. Besides being defined by the material layers 600 and 602, the driving band lead-in material profile 612 can be defined by the driving band lead-in transition layer 604 where the driving band lead-in transition layer 604 can define the driving band material profile 612 with the material layers 600 and 602. Moreover, the driving band lead-in material profile 612 can differ from the obturator material profile 322 and driving band material profile 512.

In alternative examples, the driving band lead-in 204 can include a third material layer 700. The driving band lead-in third material layer 700 can be disposed directly on the driving band lead-in second material layer 602. The third driving band lead-in third material layer 700 can be formed from the third material as discussed above with reference to the obturator third material layer 304.

In alternative examples, the driving band lead-in second material layer 602 can include a transition layer 702 defined between the driving band lead-in second material layer 602 and the driving band lead-in third material layer 700. The driving band lead-in transition layer 702 can include both the second material and the third material where the driving band lead-in transition layer 702 can include a higher concentration of the second material near an area 704 and a higher concentration of the third material near an area 706. To further illustrate, at the area 704, the driving band lead-in transition layer 702 can have 100% of the second material and at the area 706 the driving band lead-in transition layer 702 can have 100% of the third material. The material concentration can vary linearly across the driving band lead-in transition layer 702 such that at a midpoint 708, the driving band lead-in transition layer 702 can have 50% of the second material and 50% of the third material. However, the material concentration can vary in any manner across the driving band lead-in transition layer 702 such that at the midpoint 708, the driving band lead-in transition layer 702 can have 80% of the second material and 20% of the third material, 60% of the second material and 40% of the third material, 40% of the second material and 60% of the third material, or vary in an exponential manner across the transition layer 702, or the like.

In alternative examples, the driving band lead-in 204 can have a driving band lead-in material profile 710. The driving band lead-in material profile 710 can be defined by the driving band lead-in first material layer 600, the driving band lead-in second material layer 602, and the driving band lead-in third material layer 704. In addition to being defined by the material layers 600, 602, and 704, the driving band lead-in material profile 710 can be defined by the driving band lead-in transition layers 604 and 702 where the driving band lead-in transition layers 604 and 702 can define the driving band lead-in material profile 710 in conjunction with the material layers 600, 602, and 704. The driving band lead-in material profile 710 can differ from the obturator material profile 322 and the driving band material profile 512. In particular, the driving band lead-in first material layer 600 can have a width 712, which can differ from the driving band first material layer width 512 and the obturator first material layer width 516. Similarly, the driving band lead-in second material layer can vary in width from the obturator second material layer 302 and the driving band second material layer 502. Moreover, the driving band lead-in third material layer 700 can vary in width from the obturator third material layer 304.

As noted above, HDPE, PEEK, and/or acrylic in the obturator third material layer 304 can deform during discharge and form a seal 400 with the barrel 110. In examples where the driving band lead-in includes the driving band lead-in third material layer 700 that is formed with HDPE, during discharge, the driving band lead-in 204 can also form a gasket similar to the seal 400 towards the forward end 108. Thus, when a seal is formed to form the gasket, the additional gasket formed by the driving band lead-in third material layer 700 can also minimize gases from escaping around the projectile 102 and into the barrel 110.

Figure 8:
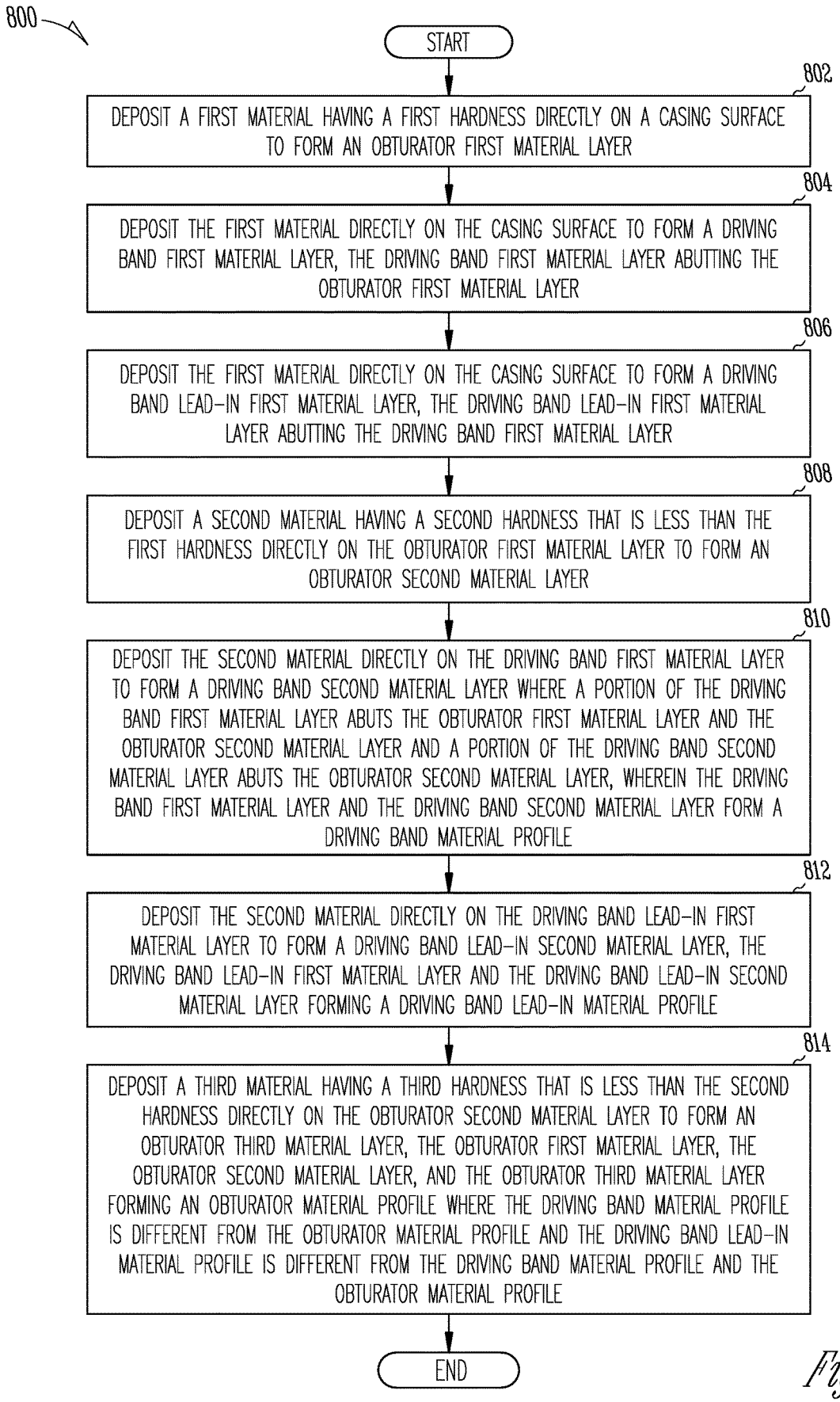
FIG. 8 shows a method for forming a projectile, in accordance with examples.

Now making reference to FIG. 8, a method 800 for forming features on a projectile in accordance with examples is shown. Initially, first material layers are formed on a casing surface of a projectile. In particular, during an operation 802, a first material can be directly deposited on the projectile casing surface to form an obturator first material layer. Moreover, during an operation 804, first material can be directly deposited on the projectile casing surface to form a driving band first material layer. The operation 804 can be performed such that the driving band material layer abuts the obturator first material layer. During an operation 806, a first material can be directly deposited on the projectile casing surface to form a driving band lead-in first material layer. The operation 806 can be performed such that the driving band lead-in first material layer abuts the driving band first material layer. The first material layer used to form the first material layers in the operations 802-806 can include a first material having a first hardness, such as nickel, as discussed above.

The operations 802-806 can be implemented with coating deposit method such as a gas dynamic cold spraying procedure. In particular, the first material in the form of a solid powder can be in accelerated in a supersonic gas jet at the projectile casing surface. When the first material impacts the projectile casing surface, the first material can undergo plastic deformation and bond with projectile casing surface at the molecular level. This type of bonding, coupled with the use of a material having a hardness in a range of a Mohs hardness of 4.0 to a Mohs hardness of 6.0, can result in robust bonding having the advantages discussed above.

Figure 9:
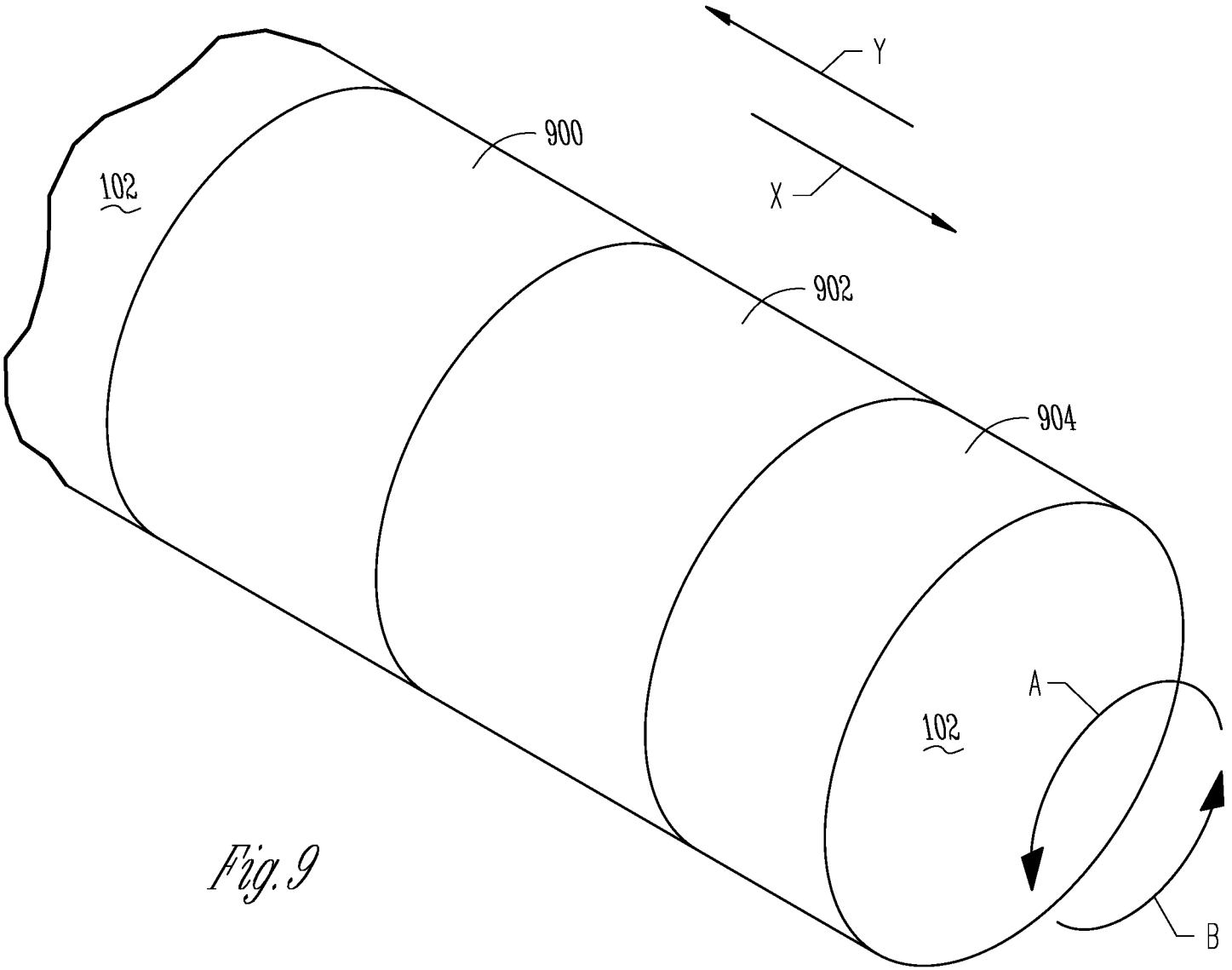
FIG. 9 shows the formation of a projectile, in accordance with examples.

Moreover, during a cold spraying process, the operations 802-806 can be performed at the same time. In particular, a nozzle can move along direction X as shown in FIG. 9 and deposit first material for the obturator first material layer 300 at an obturator area 900, first material for the driving band first material layer 300 at a driving band area 902, and first material for the driving band lead-in first material layer 300 at a driving band lead-in area 904. Moreover, during the operations 802-806 and the cold-spraying process, the projectile 102 can be rotated along either direction A or direction B and the nozzle can move along direction Y as shown in FIG. 9 and deposit first material for the obturator first material layer 300, the driving band first material layer 300, and the driving band lead-in first material layer 300. As discussed herein, the projectile 102 can be rotated along the directions A or B once the nozzle completes a pass along either the directions X or Y.

In the method 800, during an operation 808, a second material having a second hardness that is less than the first hardness can be deposited directly on the first obturator first material layer. The second material can be deposited to form an obturator second material layer. The obturator second material layer can be formed with a second material such as copper as discussed above. The obturator second material layer can be deposited with a cold-spraying process as discussed above.

As noted above, the obturator material profile 322, the driving band material profile 512, and the driving band lead-in material profile 710 can vary from each other based on the differing amounts of material in each respective layer, such as the first material layers for each of the obturator, the driving band, and the driving band lead-in. Thus, when the operation 808 is being performed to form the obturator second material layer, the operation 804 can continue to be performed to form the driving band first material layer using a cold spray process where the first material is fed to the nozzle while the nozzle passes over the driving band area 902.

The method 800 can perform an operation 810 simultaneously with the operation 808 or when the operation 808 is complete. In the operation 810, the second material can be directly deposited on the driving band first material layer to form a second driving band material layer. A portion of the driving band first material layer can abut a portion of the obturator first material layer while another portion of the driving band first material layer can abut the obturator second material layer. Moreover, a portion of the deposited driving band second material layer can abut a portion the obturator second material layer. The driving band first material layer formed during the operation 804 and the driving band second material layer formed during the operation 810 can form a driving band material profile, such as the driving band material profile 512 having the characteristics described above. The operation 810 can be performed with a cold spray process as discussed above.

The method 800 can also perform an operation 812, where a second material can be directly deposited on the driving band lead-in first material layer to form a driving band lead-in second material layer. The operation 812 can be performed simultaneously with the operations 808 and 810 or after one or both of the operations 808 and 810, or a combination thereof. Additionally, the operation 812 can be performed with a cold spray process as discussed above. The driving band lead-in first material layer and the driving band lead-in second material layer can form a driving band lead-in material profile, such as the driving band lead-in material profile 612 having the characteristics described above.

Moreover, the method 800 can perform an operation 814, where a third material having a third hardness less than the second hardness can be deposited directly on the obturator second material layer to form an obturator third material layer. An example of the third material can be HDPE as described above. The operation can be performed simultaneously with the operations 804 and 812, simultaneously with the operations 810 and 812, or after the operations 804, 810, and 812, or a combination thereof. Furthermore, the operation 814 can be performed with a cold spray process as discussed above.

In examples, the obturator first material layer, the obturator second material layer, and the obturator third material layer can form an obturator material profile, such as the obturator material profile 322 having the characteristics described above.

In an alternative example, in addition to performing the operations 802-814, a further operation can be performed where a third material having a third hardness less than the second hardness is deposited directly on the driving band lead-in second material layer. Again, the third material can be HDPE. The third material can be deposited on the driving band lead-in second material layer simultaneously with the operations 804 and 814, the operations 810 and 814, or after the operations 804, 810, and 814, or a combination thereof. Here, the driving band lead-in first material layer, the driving band lead-in second material layer, and the third driving band lead-in material layer can form a driving band lead-in material profile, such as the driving band lead-in material profile 710 having the characteristics described above.

Additional Examples

Example 1 is a projectile comprising: an artillery shell having a casing that defines a surface; an obturator disposed at the casing surface, the obturator including: an obturator first material layer disposed directly on the casing surface, the obturator first material layer being formed of a first material having a first hardness; an obturator second material layer disposed directly on the obturator first material layer, the obturator second material layer being formed of a second material having a second hardness that is less than the first hardness; and an obturator third material layer disposed directly on the obturator second material layer, the obturator third material layer being formed of a third material having a third hardness that is less than the second hardness; a driving band disposed on the casing layer abutting the obturator and forward the obturator, the driving band including: a driving band first material layer disposed directly on the casing surface and formed of the first material; and a driving band second material layer disposed directly on the driving band first material layer and formed of the second material; and a driving band lead-in disposed on the casing layer abutting the driving band and forward the driving band, the driving band lead-in including: a driving band lead-in first material layer disposed directly on the casing surface and formed of the first material; and a driving band lead-in second material layer disposed directly on the driving band lead-in first material layer and formed of the second material.

In Example 2, the subject matter of Example 1 includes, wherein: the obturator first material layer, the obturator second material layer, and the obturator third material layer form an obturator material profile; the driving band first material layer and the driving band second material layer form a driving band material profile that is different from the obturator material profile; the driving band lead-in first material layer and the driving band lead-in second material layer form a driving band lead-in material profile that is different from the obturator material profile and driving band material profile; and the driving band lead-in further comprises a driving band lead-in third material layer disposed directly on the driving band lead-in second material layer, the driving band lead-in third material layer being formed of the third material where the driving band lead-in first material layer, the driving band lead-in second material layer, and the driving band lead-in third material layer form the driving band lead-in material profile.

In Example 3, the subject matter of Example 2 includes, wherein each of the obturator first, second, and third material layers, each of the driving band first and second material layers, and each of the driving band lead-in first, second, and third material layers are cold-sprayed.

In Example 4, the subject matter of Examples 2-3 includes, wherein the first material is nickel, the second material is copper, and the third material is one of High Density Polyethylene, Polyether ether ketone, or acrylic.

In Example 5, the subject matter of Examples 2-4 includes, wherein an obturator transition layer is defined between the obturator first material layer and the obturator second material layer and a driving band transition layer is defined between the driving band first material layer and the driving band second material layer where a composition of the obturator transition layer is different from a composition of the driving band transition layer.

In Example 6, the subject matter of Example 5 includes, wherein a driving band lead-in transition layer is defined between the driving band lead-in first material layer and the driving band lead-in second material layer, where a composition of the driving band lead-in layer transition layer is different from the obturator transition layer composition and the driving band transition layer composition.

In Example 7, the subject matter of Examples 1-6 includes, wherein the obturator extends a first distance away from the casing surface and the driving band extends a second distance away from the casing surface where the first distance is greater than the second distance.

Example 8 is a method of forming a projectile having an artillery shell with a casing that defines a surface, the method comprising: depositing a first material having a first hardness directly on the casing surface to form an obturator first material layer; depositing the first material directly on the casing surface and abutting the obturator first material layer to form a driving band first material layer; depositing the first material directly on the casing surface abutting the driving band first material layer to form a driving band lead-in first material layer; depositing a second material having a second hardness that is less than the first hardness directly on the obturator first material layer to form an obturator second material layer; depositing the second material directly on the driving band first material layer to form a driving band second material layer where a portion of the driving band first material layer abuts the obturator first material layer and the obturator second material layer and a portion of the driving band second material layer abuts the obturator second material layer, wherein the driving band first material layer and the driving band second material layer form a driving band material profile; depositing the second material directly on the driving band lead-in first material layer to form a driving band lead-in second material layer, wherein the driving band lead-in first material layer and the driving band lead-in second material layer form a driving band lead-in material profile; and depositing a third material having a third hardness that is less than the second hardness directly on the obturator second material layer to form an obturator third material layer, wherein the obturator first material layer, the obturator second material layer, and the obturator third material layer form an obturator material profile where the driving band material profile is different from the obturator material profile and the driving band lead-in material profile is different from the driving band material profile and the obturator material profile.

In Example 9, the subject matter of Example 8 includes, wherein each of the depositing operations are cold spray depositing operations.

In Example 10, the subject matter of Examples 8-9 includes, the method further comprising depositing the third material directly on the driving band lead-in second material layer to form a driving band lead-in third material layer where the driving band lead-in first material layer, the driving band lead-in second material layer, and the driving band lead-in third material layer form the driving band lead-in material profile.

In Example 11, the subject matter of Example 10 includes, wherein the first material is nickel, the second material is copper, and the third material is one of High Density Polyethylene, Polyether ether ketone, or acrylic.

In Example 12, the subject matter of Examples 10-11 includes, the method further comprising: depositing an obturator transition layer is between the obturator first material layer and the obturator second material layer; depositing a driving band transition layer between the driving band first material layer and the driving band second material layer where a composition of the obturator transition layer is different from a composition of the driving band transition layer; and depositing a driving band lead-in transition layer between the driving band lead-in first material layer and the driving band lead-in second material layer, where a composition of the driving band layer transition layer is different from the obturator transition layer composition and the driving band transition layer composition.

In Example 13, the subject matter of Examples 8-12 includes, wherein the obturator extends a first distance away from the casing surface and the driving band extends a second distance away from the casing surface where the first distance is greater than the second distance.

Example 14 is a projectile comprising: an artillery shell having a casing that defines a surface; an obturator first material layer disposed directly on the casing surface; an obturator second material layer disposed directly on the obturator first material layer; an obturator third material layer disposed directly on the obturator second material layer; a driving band first material layer disposed directly on the casing surface; and a driving band second material layer disposed directly on the driving band first material layer; a driving band lead-in first material layer disposed directly on the casing surface; and a driving band lead-in second material layer disposed directly on the driving band lead-in first material layer.

In Example 15, the subject matter of Example 14 includes, wherein: the obturator first material layer is formed of a first material having a first hardness, the obturator second material layer is formed of a second material having a second hardness that is less than the first hardness, the obturator third material layer is formed of a third material having a third hardness that is less than the second hardness, wherein the obturator first material layer, the obturator second material layer, and the obturator third material layer form an obturator material profile; the driving band first material layer being formed of the first material and the driving band second material layer being formed of the second material where the driving band first material layer and the driving band second material layer form a driving band material profile that is different from the obturator material profile; and the driving band lead-in first material layer being formed of the first material and the driving band lead-in second material layer being formed of the second material, wherein the driving band lead-in first material layer and the driving band lead-in second material layer form a driving band lead-in material profile that is different from the obturator material profile and driving band material profile.

In Example 16, the subject matter of Example 15 includes, wherein the driving band lead-in further comprises a driving band lead-in third material layer disposed directly on the driving band lead-in second material layer, the driving band lead-in third material layer being formed of the third material where the driving band lead-in first material layer, the driving band lead-in second material layer, and the driving band lead-in third material layer form the driving band lead-in material profile.

In Example 17, the subject matter of Example 16 includes, wherein each of the obturator material layers, each of the driving band material layers, and each of the driving band lead-in materials layers are cold-sprayed during the same fabrication process.

In Example 18, the subject matter of Examples 16-17 includes, wherein an obturator transition layer is defined between the obturator first material layer and the obturator second material layer and a driving band transition layer is defined between the driving band first material layer and the driving band second material layer where a composition of the obturator transition layer is different from a composition of the driving band transition layer.

In Example 19, the subject matter of Example 18 includes, wherein a driving band lead-in transition layer is defined between the driving band lead-in first material layer and the driving band lead-in second material layer, where a composition of the driving band layer transition layer is different from the obturator transition layer composition and the driving band transition layer composition.

In Example 20, the subject matter of Examples 14-19 includes, wherein the obturator first material layer, the obturator second material layer, and the obturator third material layer form an obturator that extends a first distance away from the casing surface and the driving band first material layer and the driving band second material layer form a driving band that extends a second distance away from the casing surface where the first distance is greater than the second distance.

Example 21 is at least one machine-readable medium including instructions that, when executed by processing circuitry, cause the processing circuitry to perform operations to implement of any of Examples 1-20.

Example 22 is an apparatus comprising means to implement of any of Examples 1-20.

Although teachings have been described with reference to specific example teachings, it will be evident that various modifications and changes may be made to these teachings without departing from the broader spirit and scope of the teachings. Accordingly, the specification and drawings are to be regarded in an illustrative rather than a restrictive sense. The accompanying drawings that form a part hereof, show by way of illustration, and not of limitation, specific teachings in which the subject matter may be practiced. The teachings illustrated are described in sufficient detail to enable those skilled in the art to practice the teachings disclosed herein. Other teachings may be utilized and derived therefrom, such that structural and logical substitutions and changes may be made without departing from the scope of this disclosure. This Detailed Description, therefore, is not to be taken in a limiting sense, and the scope of various teachings is defined only by the appended claims, along with the full range of equivalents to which such claims are entitled.

What is claimed is:

1. A projectile comprising:

an artillery shell having a casing that defines a surface;

an obturator disposed at the casing surface, the obturator including:

an obturator first material layer disposed directly on the casing surface, the obturator first material layer being formed of a first material having a first hardness;

an obturator second material layer disposed directly on the obturator first material layer, the obturator second material layer being formed of a second material having a second hardness that is less than the first hardness; and an obturator third material layer disposed directly on the obturator second material layer, the obturator third material layer being formed of a third material having a third hardness that is less than the second hardness;

a driving band disposed on the casing layer abutting the obturator and forward the obturator, the driving band including:

a driving band first material layer disposed directly on the casing surface and formed of the first material; and a driving band second material layer disposed directly on the driving band first material layer and formed of the second material; and a driving band lead-in disposed on the casing layer abutting the driving band and forward the driving band, the driving band lead-in including:

a driving band lead-in first material layer disposed directly on the casing surface and formed of the first material; and a driving band lead-in second material layer disposed directly on the driving band lead-in first material layer and formed of the second material.

2. The projectile of claim 1, wherein:

the obturator first material layer, the obturator second material layer, and the obturator third material layer form an obturator material profile;

the driving band first material layer and the driving band second material layer form a driving band material profile that is different from the obturator material profile;

the driving band lead-in first material layer and the driving band lead-in second material layer form a driving band lead-in material profile that is different from the obturator material profile and driving band material profile; and the driving band lead-in further comprises a driving band lead-in third material layer disposed directly on the driving band lead-in second material layer, the driving band lead-in third material layer being formed of the third material where the driving band lead-in first material layer, the driving band lead-in second material layer, and the driving band lead-in third material layer form the driving band lead-in material profile.

3. The projectile of claim 2, wherein each of the obturator first, second, and third material layers, each of the driving band first and second material layers, and each of the driving band lead-in first, second, and third material layers are cold-sprayed.

4. The projectile of claim 2, wherein the first material is nickel, the second material is copper, and the third material is one of High Density Polyethylene, Polyether ether ketone, or acrylic.

5. The projectile of claim 2, wherein an obturator transition layer is defined between the obturator first material layer and the obturator second material layer and a driving band transition layer is defined between the driving band first material layer and the driving band second material layer where a composition of the obturator transition layer is different from a composition of the driving band transition layer.

6. The projectile of claim 5, wherein a driving band lead-in transition layer is defined between the driving band lead-in first material layer and the driving band lead-in second material layer, where a composition of the driving band lead-in layer transition layer is different from the obturator transition layer composition and the driving band transition layer composition.

7. The projectile of claim 1, wherein the obturator extends a first distance away from the casing surface and the driving band extends a second distance away from the casing surface where the first distance is greater than the second distance.

8. A method of forming a projectile having an artillery shell with a casing that defines a surface, the method comprising:

depositing a first material having a first hardness directly on the casing surface to form an obturator first material layer;

depositing the first material directly on the casing surface and abutting the obturator first material layer to form a driving band first material layer;

depositing the first material directly on the casing surface abutting the driving band first material layer to form a driving band lead-in first material layer;

depositing a second material having a second hardness that is less than the first hardness directly on the obturator first material layer to form an obturator second material layer;

depositing the second material directly on the driving band first material layer to form a driving band second material layer where a portion of the driving band first material layer abuts the obturator first material layer and the obturator second material layer and a portion of the driving band second material layer abuts the obturator second material layer, wherein the driving band first material layer and the driving band second material layer form a driving band material profile;

depositing the second material directly on the driving band lead-in first material layer to form a driving band lead-in second material layer, wherein the driving band lead-in first material layer and the driving band lead-in second material layer form a driving band lead-in material profile; and depositing a third material having a third hardness that is less than the second hardness directly on the obturator second material layer to form an obturator third material layer, wherein the obturator first material layer, the obturator second material layer, and the obturator third material layer form an obturator material profile where the driving band material profile is different from the obturator material profile and the driving band lead-in material profile is different from the driving band material profile and the obturator material profile.

9. The method of claim 8, wherein each of the depositing operations are cold spray depositing operations.

10. The method of claim 8, the method further comprising depositing the third material directly on the driving band lead-in second material layer to form a driving band lead-in third material layer where the driving band lead-in first material layer, the driving band lead-in second material layer, and the driving band lead-in third material layer form the driving band lead-in material profile.

11. The method of claim 10, wherein the first material is nickel, the second material is copper, and the third material is one of High Density Polyethylene, Polyether ether ketone, or acrylic.

12. The method of claim 10, the method further comprising:

depositing an obturator transition layer is between the obturator first material layer and the obturator second material layer;

depositing a driving band transition layer between the driving band first material layer and the driving band second material layer where a composition of the obturator transition layer is different from a composition of the driving band transition layer; and depositing a driving band lead-in transition layer between the driving band lead-in first material layer and the driving band lead-in second material layer, where a composition of the driving band layer transition layer is different from the obturator transition layer composition and the driving band transition layer composition.

13. The method of claim 8, wherein the obturator extends a first distance away from the casing surface and the driving band extends a second distance away from the casing surface where the first distance is greater than the second distance.

14. A projectile comprising:

an artillery shell having a casing that defines a surface;

an obturator first material layer disposed directly on the casing surface;

an obturator second material layer disposed directly on the obturator first material layer;

an obturator third material layer disposed directly on the obturator second material layer;

a driving band first material layer disposed directly on the casing surface; and a driving band second material layer disposed directly on the driving band first material layer;

a driving band lead-in first material layer disposed directly on the casing surface; and a driving band lead-in second material layer disposed directly on the driving band lead-in first material layer.

15. The projectile of claim 14, wherein:

the obturator first material layer is formed of a first material having a first hardness, the obturator second material layer is formed of a second material having a second hardness that is less than the first hardness, the obturator third material layer is formed of a third material having a third hardness that is less than the second hardness, wherein the obturator first material layer, the obturator second material layer, and the obturator third material layer form an obturator material profile;

the driving band first material layer being formed of the first material and the driving band second material layer being formed of the second material where the driving band first material layer and the driving band second material layer form a driving band material profile that is different from the obturator material profile; and the driving band lead-in first material layer being formed of the first material and the driving band lead-in second material layer being formed of the second material, wherein the driving band lead-in first material layer and the driving band lead-in second material layer form a driving band lead-in material profile that is different from the obturator material profile and driving band material profile.

16. The projectile of claim 15, wherein the driving band lead-in further comprises a driving band lead-in third material layer disposed directly on the driving band lead-in second material layer, the driving band lead-in third material layer being formed of the third material where the driving band lead-in first material layer, the driving band lead-in second material layer, and the driving band lead-in third material layer form the driving band lead-in material profile.

17. The projectile of claim 16, wherein each of the obturator material layers, each of the driving band material layers, and each of the driving band lead-in materials layers are cold-sprayed during the same fabrication process.

18. The projectile of claim 16, wherein an obturator transition layer is defined between the obturator first material layer and the obturator second material layer and a driving band transition layer is defined between the driving band first material layer and the driving band second material layer where a composition of the obturator transition layer is different from a composition of the driving band transition layer.

19. The projectile of claim 18, wherein a driving band lead-in transition layer is defined between the driving band lead-in first material layer and the driving band lead-in second material layer, where a composition of the driving band layer transition layer is different from the obturator transition layer composition and the driving band transition layer composition.

20. The projectile of claim 14, wherein the obturator first material layer, the obturator second material layer, and the obturator third material layer form an obturator that extends a first distance away from the casing surface and the driving band first material layer and the driving band second material layer form a driving band that extends a second distance away from the casing surface where the first distance is greater than the second distance.

* * * * *